United States Patent [19]

Casagrande

[11] Patent Number: 4,997,385

[45] Date of Patent: Mar. 5, 1991

[54] ELECTRICAL CONNECTOR

[75] Inventor: Mario Casagrande, Caselette, Italy

[73] Assignee: AMP Incorporated, Harrisburg, Pa.

[21] Appl. No.: 499,106

[22] Filed: Mar. 26, 1990

[30] Foreign Application Priority Data

Mar. 29, 1989 [IT] Italy ..... 19937 A/89

[51] Int. Cl.[5] ..... H01R 13/15

[52] U.S. Cl. ..... 439/259; 439/342

[58] Field of Search ..... 439/595, 744, 259, 261, 439/262, 264, 342, 343, 138, 139, 880, 883, 347, 854, 855, 268, 269, 266

[56] References Cited

U.S. PATENT DOCUMENTS

| | | | |
|---|---|---|---|
| 3,728,669 | 4/1973 | Churla | 439/860 |
| 3,915,537 | 10/1975 | Harris et al. | 439/249 |
| 4,349,239 | 9/1982 | Roberts et al. | 439/287 |
| 4,383,724 | 5/1983 | Verhoeven | 439/856 |
| 4,498,725 | 2/1985 | Bright et al. | 439/342 |
| 4,544,220 | 10/1985 | Aiello et al. | 439/595 |
| 4,744,768 | 5/1988 | Rios | 439/262 |

FOREIGN PATENT DOCUMENTS

| | | | |
|---|---|---|---|
| 122486 | 10/1984 | European Pat. Off. | 439/342 |
| 61816 | 5/1968 | German Democratic Rep. | 439/851 |

*Primary Examiner*—David L. Pirlot
*Assistant Examiner*—Julie R. Daulton

[57] ABSTRACT

This invention relates to a low-insertion-force electrical connector of the type in which a pair of matable housings (10,110), containing complementary matable contacts or terminals (30,150), are matable by the lateral movement of one housing (10) relative to the other (110). Sufficient safeguards are designed in the system hereof to insure a state of positive mating, or in the alternative, a state of non-mating. The contacts (150) of housing (110) are solder contacts having a first leg (162) for mounting engagement with a circuit board, and a pair of diverging arms (164) projecting in a plane above said first leg, with portions (166) thereof turned inwardly and downwardly and that the endmost portions (168) are bent normal thereto for laterally receiving a male pin member (30) mounted in housing (10). Leverage means (124,126) are provided on housing (110) to effect such lateral movement. The mating/non-mating safeguards include means (156) acting against the movement of lever (124), resistance to such movement of projections (102) into and out of channel (132) and depression (136), and finally the mating resistance of male pin member (30) with femal contact (150).

7 Claims, 4 Drawing Sheets

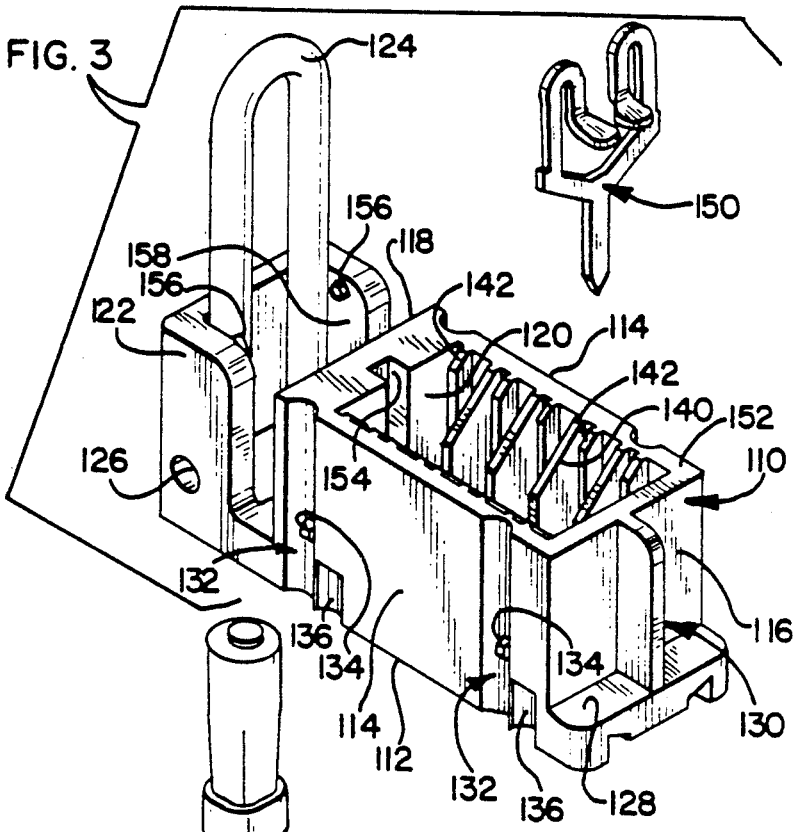
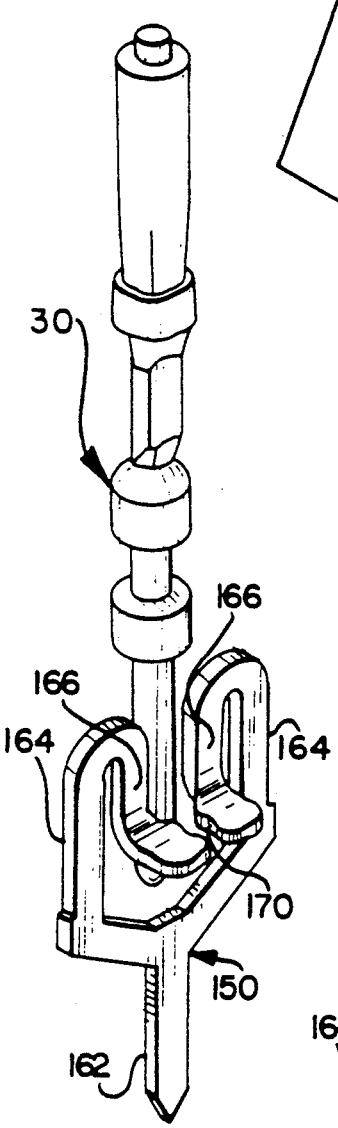
FIG. 4A
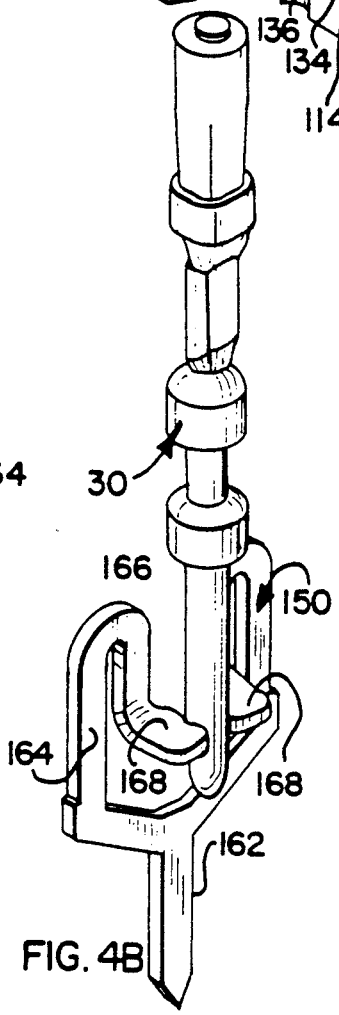
FIG. 4B
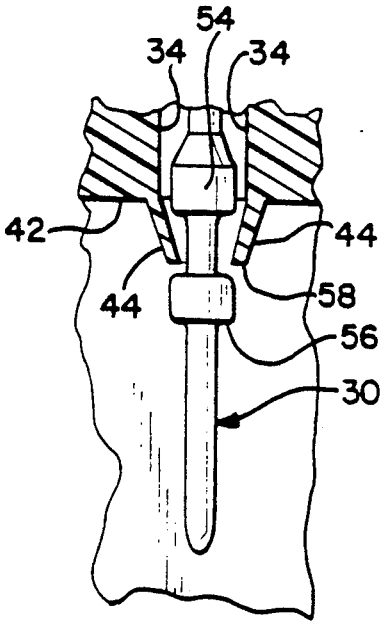
FIG. 2

ELECTRICAL CONNECTOR

BACKGROUND OF THE INVENTION

The present invention is directed to a low-insertion-force electrical connector of the type in which a pair of matable housings are matable by the lateral movement of one housing relative to the other.

An early version of a zero on low-insertion-force connector is taught in U.S. Pat. No. 3,915,537. In one embodiment thereof contact pins or leads may be slid between matable contact arms from the side. Specifically, the contact elements may be housed in recesses in a base. The recesses have a length such that the pins can be first inserted into the recesses and then the substrate or other electronic package moved along the surface of the base to push the pins in between the arms and contact surfaces thereon.

A similar connector is taught in U.S. Pat. No. 4,498,725, where such connector comprises a housing and a cover slidingly movable across the surface of the housing. Uniquely shaped contact elements, mounted in said housing, have a pair of parallel, spaced apart upwardly extending arms which are capable of being twisted about a vertical axis. Converging fingers extend laterally from the arms with the free ends of the fingers being spaced apart a distance less than the diameter of a pin or thickness of a lead which is to be inserted in between the free ends.

A further related connector is disclosed in U.S. Pat. No. 4,349,239, in which identical matable connectors contain identical terminals therein. By the unusual design of the terminals, each terminal has four points of contact with its complementary terminal. The mating thereof is achieved by a tool, such as a screwdriver to effect the relative movement of the housings.

The present invention avoids certain complexities of the known connectors, and exhibits a high degree of stability against premature unmating, such as may be experienced in automotive applications where vibrations from the road may cause problems with electrical circuit continuity.

SUMMARY OF THE INVENTION

The stability of the connector of this invention is achieved herein by the provision of a low-insertion-force electrical connector comprising a first housing and a second housing matable therewith, where the first housing contains a plurality of male pin members, and the second housing contains a like plurality of contact elements matable with the male pin members. The mating thereof is achieved by the lateral movement of said housings. The contact elements are solder contacts having a first leg for mounting engagement with a circuit board, and a pair of diverging arms projecting in a plane above said first leg, with portions thereof turned inwardly and downwardly and that the endmost portions are bent normal thereto for laterally receiving one of the male pin members. Leverage means are provided on said housings for laterally moving the housings relative to one another. Further, means are provided for securing the male pin members in the first housing, and for locking the respective housings to one another so as to avoid a premature unmating thereof.

BRIEF DESCRIPTION OF THE DRAWINGS

FIG. 2 is a partial, internal side view showing the primary locking mechanism for the male pin members.

FIG. 3 is an exploded perspective view of a second housing, matable with the first housing of FIG. 1, and a contact element matable.

FIGS. 1A and 4B are enlarged perspective views of the relative positions of a male pin member and its complementary contact element, for unmated and mated positions, respectively.

DETAILED DESCRIPTION OF THE INVENTION

The electrical connector of this invention is of the type in which a pair of matable housings, formed of an insulative material, such as plastic, and containing complementary electrical contacts or terminals, are matable by the lateral movement of one housing relative to the other.

Figure 1:
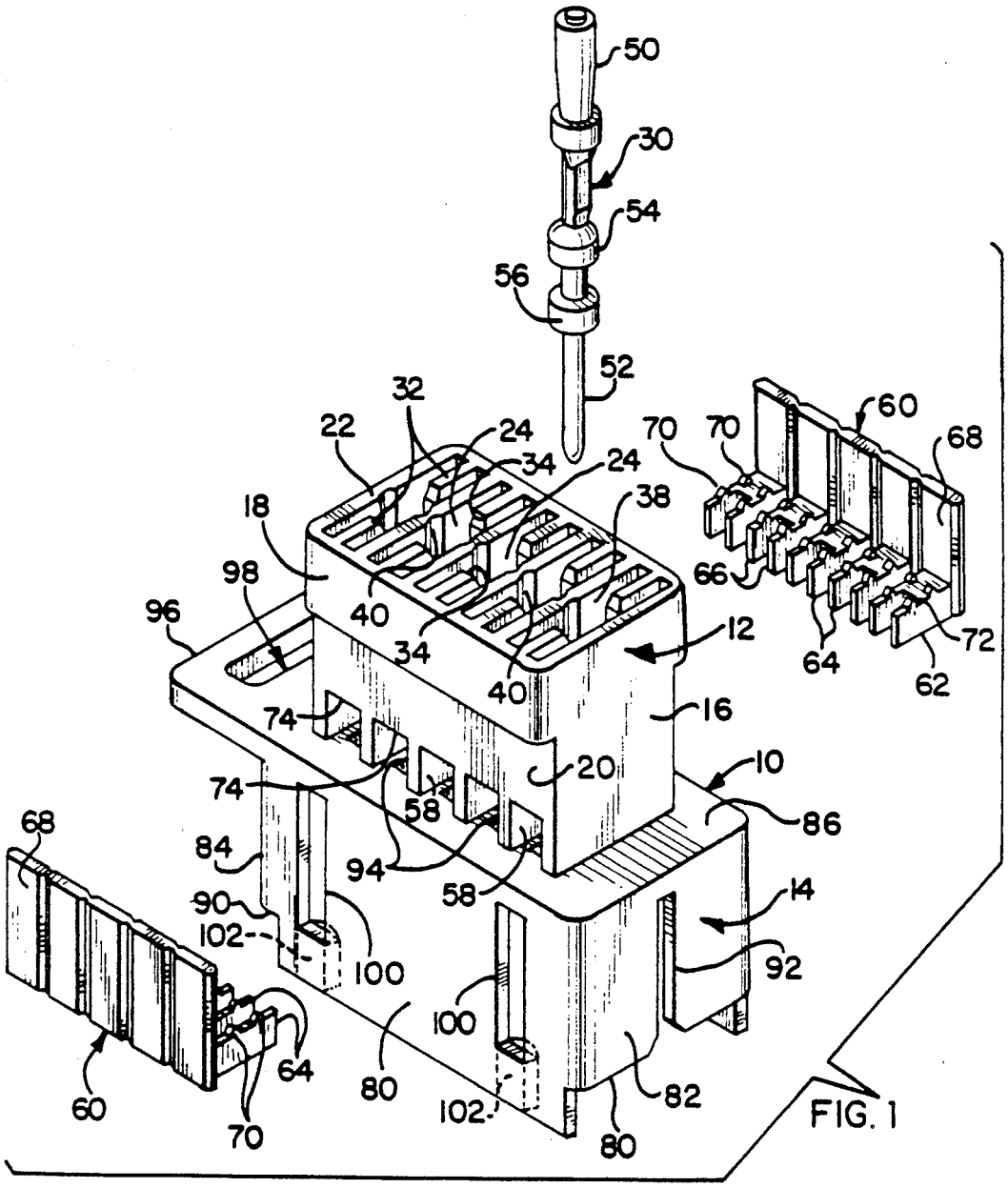
FIG. 1 is an exploded perspective view of a first housing and male pin member for the low-insertion-force electrical connector according to this invention, including a pair of optional secondary, male pin locking members.

The first such housing 10, illustrated in FIG. 1, comprises an upper portion 12 and a lower portion 14. The upper portion 12 is defined by parallel end walls 16 and side walls 18, where such side walls are characterized by a recessed portion 20, the purpose of which will be explained hereinafter.

Figure 1A:
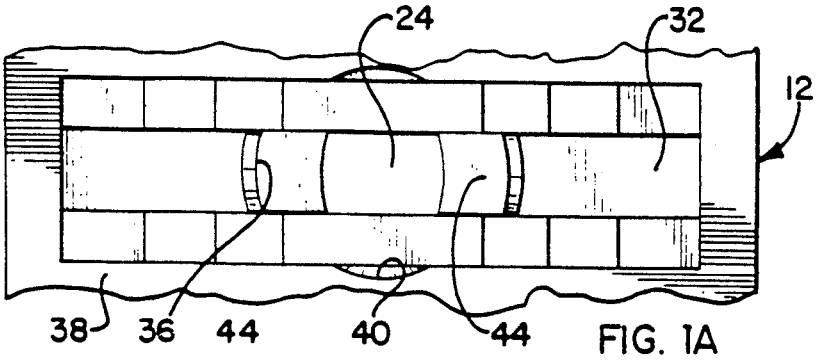
FIG. 1A is an enlarged top view of a single male pin member containing housing of FIG. 1.

The upper surface 22 thereof reveals a plurality of exposed cavities 24 into which a male pin member 30, shown in exploded position above the housing 10 of FIG. 1, is inserted. Such cavity 24 is characterized by a pair of opposing partitions 32, where the facing walls 34 are concave 36 in configuration, see FIG. 1A. Disposed along the mid-position of each cavity wall 38 and the inside of the side walls 18 are concave slots 40, such that the central portion of each said cavity has a circular configuration for slidably receiving the male pin member 30. Finally, for securing said male pin member 30 in position, particularly against premature vertical movement thereof, the lower wall 42 at the facing walls 34 are provided with inwardly directed lances 44 (FIG. 2). The importance thereof will become apparent in the description of the male pin member 30.

The male pin member 30 comprises a wire terminal or crimping portion 50 at one end thereof, and at the opposite end 52 a male pin for electrical engagement with a complementary female contact. Between said ends, the shank of the male pin member 30 is provided with a pair of spaced apart annular ribs 54,56. It will thus be observed, particularly in FIG. 2, that as the male pin member 30 is inserted into the cavity 24, the lower rib 56 passes the pair of lances 44, where such lances, in a relaxed state, project into the space between the ribs 54,56. Should there be an attempt to withdraw the male pin member 30 from the cavity 24, the ends 58 of lances 44 will act against the rib 56 and prevent such withdrawal. With the provisions of such locking lances 44 on the housing 10, it is possible to use "lanceless" male contacts and the problems associated therewith as known in the art.

Figure 8:
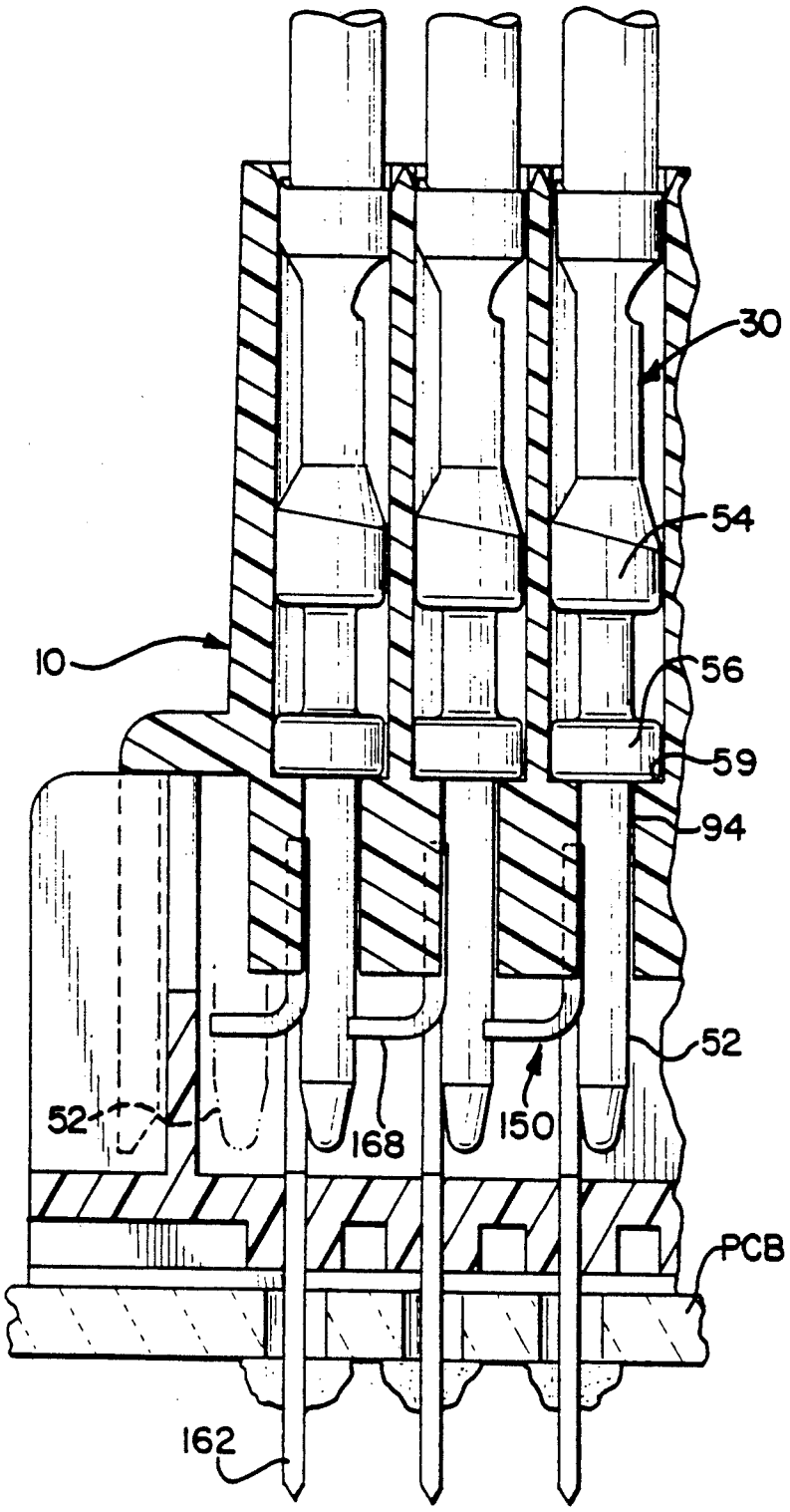
FIG. 8 is a partial, longitudinal sectional view of a preassembled connector of this invention, illustrating in phantom lines the mated position for one set of complementary contacts.

Finally, as most apparent by the showing in FIG. 8, as the male pin member 30 is loaded or inserted into the cavity 24, the annular rib 56 is caused to seat against an annular shoulder 59, which shoulder coincides with the division between housing portions 12 and 14.

An optional feature, but further support for the male pin member 30, are the two locking mechanisms 60 shown in exploded position at the respective sides of housing 10. The locking mechanisms 60 are "L" shaped having a first leg 62 which is characterized by plural pairs of arms 64, one pair for each cavity 24 and/or male pin member 30. Each such pair of arms, at the forward end 66 thereof, is tapered inwardly so as to contact or abut the shank portion of male pin member 30 intermediate the ribs 54,56. To make such contact, the side walls 18 are provided with plural windows 58 within the recessed portion 20. The horizontal first leg 62 enters into such windows 58 to a depth that allows vertical leg 68 to lie contiguous with side wall 18 within the recessed portion 20. In order to retain the engagement of the locking mechanism 60 with the housing 10, plural teeth 70 are provided along upper surface 72 of the horizontal or first leg 62. While such teeth 70 provide some resistance to the entry of the locking mechanism into the windows 58, by virtue of their contact with upper edge 74 of such windows, a comparable resistance is presented to the premature withdrawal therefrom.

The lower portion 14 of housing 10 comprises side walls 80, end walls 82,84 and a top wall 86 upon which upper portion 12 is fixed. End walls 82,84 are characterized by lower edges 88,90 spaced from the bottom of the corresponding bottom of side walls 80. Additionally, end wall 82 contains a central slot 92 through most of its vertical extent, for receipt of a complementary flange to be described hereinafter. As will become apparent in the further description hereafter, the slot 92 also allows for a slight flexing movement between respective side walls 80.

Disposed along the top wall 86, beneath a corresponding cavity 24, are a plurality of transverse slots or openings 94. The openings 94 allow for the passage therethrough of the male pin ends 52 whereby engagement therewith may be made with a complementary female contact in a manner to be described later. A further feature of top wall 86 is the provision, at one end 96 thereof, of a transverse slot 98 for receiving a pivotal mating lever described hereinafter.

A final feature of the lower portion 14 of housing 10 are the two windows 100 on each sidewall 80, and the inner projections 102 aligned below each said window. The extent of such projections 102 are shown partially in phantom lines in FIG. 1.

FIG. 3 illustrates the housing 110 matable with first housing 10, described above. Such matable housing 110 comprises a base 112, parallel side walls 114, end wall 116, and intermediate transverse wall 118, which together form a box-shaped housing having a central cavity 120 therewithin. Adjacent to, but spaced from transverse wall 118 is a U-shaped channel 122 containing a lever arm 124 mounted for limited pivotal movement about journals 126. The direction of limited movement is defined by the "arrow" of FIG. 3.

Beginning first with the external features of matable housing 110, end wall 116 contains a stepped portion 128 comparable in size with the cut-out portion defined by edge 88 and side walls 80 of housing portion 14. That is, the stepped portion 128 is adapted to accommodate the above defined opening in the mated position for housing 10 with housing 110. Additionally, projecting above stepped portion 128 is vertical flange 130, which, when such housings are mated, will be received in slot 92.

Each side wall 114 contains a pair of vertical channels 132, preferably concave in section, along the full height of each said wall. Near the base of each said channel 132 is a projection 134 which functions as a temporary stop in the mating of the housings 10,110. Adjacent each said channel 132, in a direction away from the lever arm 124, is a depression 136, the cross section of which is preferably semi-circular and of a size essentially comparable to that of channel 132.

Internally, the central cavity 120 is characterized by a plurality of opposed major partitions 140, where the axial dimension and arrangement thereof corresponds with the axial dimensions of the cavities 24 in housing 10. Intermediate said major partitions 140, and walls 116,118, as the case may be, is a minor partition 142. The positioning of such minor partition 142 will be appreciated more in the discussion which follows, but it may be noted that the spacing of such partition 142 with an adjacent major partition 140 is such as to slidably receive a solder post female contact 150, where the latter is shown in a premating position above housing 110, and will be described later.

As may be apparent from the discussion above, the aligning and mating of housings 10,110, and consequently the complementary contacts therein, is towards one another by first aligning the lever arm 124 with transverse slot 98, and projections 102 with channels 132, followed by further movement whereby projections 102 pass channel projection 134. In this position the undersurface of top wall 86 lies against top surface 152 of housing 110, for lateral movement thereagainst.

In order to accommodate this premating position, where lever arm 124 is vertically oriented, an internal vertical slot 154 in central cavity 120 is provided. Since the male pin members laterally move to effect mating with a complementary female contact 150, such slot provides room for and represents the initial position for the endmost male pin member 30.

One feature of this invention is its ability to provide a connector that is capable of avoiding an indeterminate or partial mating. That is, there are sufficient safeguards or features that assure a secure and stable mated condition, or an unmated condition where there can be no electrical contact, or short circuit. One such feature is the provision of opposing projections 156 along the inside wall 158 of U-shaped channel 122. The importance thereof will become apparent hereinafter.

Turning now to the female contact 150, such contact may be described as a solder post having a slotted means for receiving a complementary male pin member. The female contact 150 of this invention, fabricated from a flat sheet metal blank, and as illustrated in FIGS. 4A and 4B, comprises a solder post 162 for engagement with a PCB, for example, a pair of upstanding essentially parallel arms 164, which at a mid-position turn inwardly and downwardly 166 remaining in an essentially parallel position. The ends 168 thereof are turned at right angles thereto so as to define a space 170 therebetween, which space is of a dimension to receive the male pin end 52. While such ends 168 possess a sufficient degree of flexibility to receive a male pin end 52, by virtue of the fact that the major dimension is perpendicular to such male pin end, there is a greater strength of retention than one would experience if the major dimension thereof were parallel to the male pin end.

Figure 5:
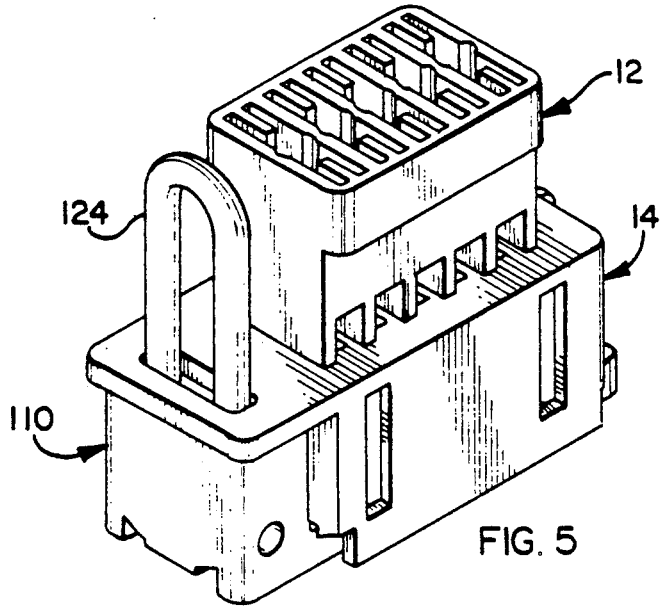
FIG. 5 is a perspective view of the preassembled housing members comprising the low-insertion-force electrical connector of this invention.
Figure 6:
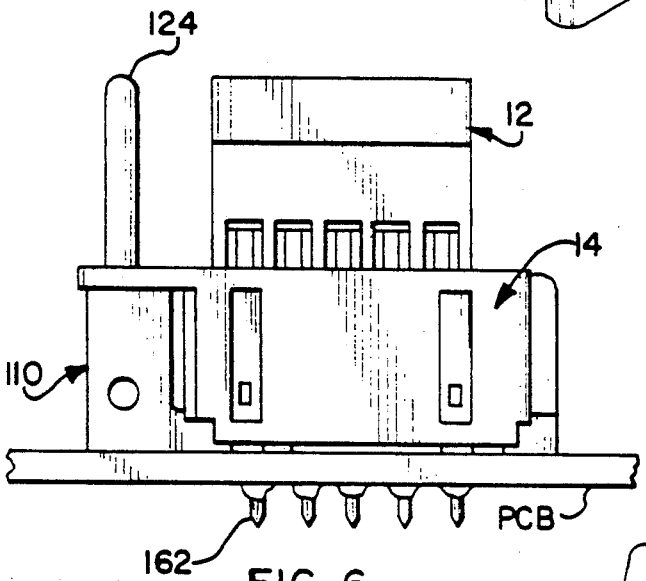
FIG. 6 is a front elevation of the preassembled connector of FIG. 5, where such connector corresponds to the position of the matable contacts of FIG. 4A.
Figure 7:
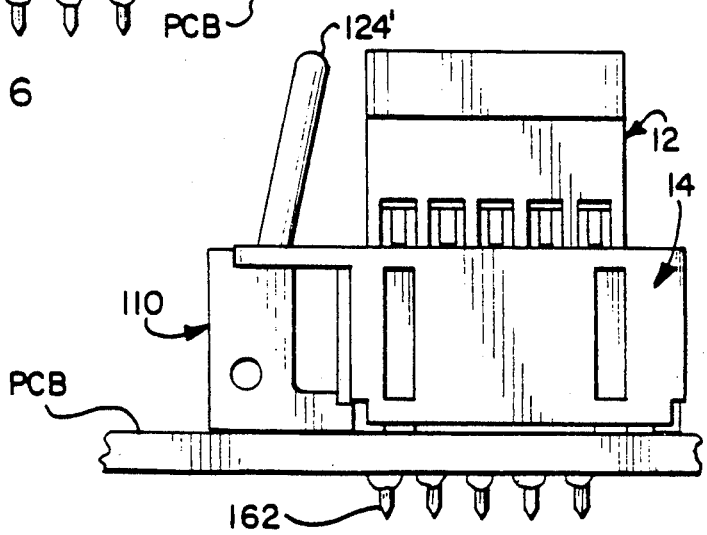
FIG. 7 is a front elevation similar to FIG. 6, but corresponding to the position of the matable contacts of FIG. 4B.

FIGS. 5 and 6 illustrate the relationship of housings 10,110 in a position just prior to the full mating of the complementary terminals disposed therein. Note that the lever arm 124 is in a vertical position. To effect mating of such terminals, the lever is moved towards the housings which causes housing 10 to laterally move relative to housing 110 (compare FIG. 6 to FIG. 7, and the illustrated showings of FIG. 8). Note also that such Figures illustrate the manner of mounting the housings to a PCB, i.e. by soldering the solder posts 162. During such lateral movement (a) the lever arm 124 must overcome the resistance of passing projections 156, (b) housing 10 must overcome the resistance of moving the projections 102 from channel 132 to depression 136, and (c) the male pin member 30 must overcome the resistance to entering the slot 170 of female contact 150. The latter is best illustrated in the FIGS. 4A and 4B, namely, unmated and mated, respectively.

Notwithstanding that the mating of the electrical connector of this invention is characterized as low-insertion-force, one will not experience the fear of a premature mating or unmating as may be experienced with other low-insertion-force connectors. The system hereof incorporates sufficient safeguards to insure satisfaction and confidence in its use. With such confidence, one can use the connector of this invention as a circuit breaker or interrupter during maintenance, for example, on the electrical system of an automobile.

I claim:

1. A low-insertion-force electrical connector comprising a first housing and a second housing matable therewith, said first housing having a pair of parallel side walls with a plurality of cavities therebetween containing a like plurality of male pin members, and said second housing having a pair of side walls essentially parallel to said first housing side walls, and containing a like plurality of contact elements matable with said male pin members, where said mating is achieved by the movement of said housings in a plane parallel to said side walls, characterized in that said contact elements are solder contacts having a first leg for mounting engagement with a circuit board, and a pair of diverging arms projecting in a plane above said first leg, with portions thereof turned inwardly and downwardly where the endmost portions of said diverging arms are bent normal thereto for laterally receiving one of said male pin members, and leverage means on said housings for moving said housings from an unmated contact position to a mated contact position.

2. The low-insertion-force electrical connector of claim 1, characterized in that each said cavity of said first housing contains a pair of opposed and separated partitions between which said male pin member is inserted, and that each said partition contains an inwardly directed projection for engagement with said male pin member.

3. The low-insertion-force electrical connector of claim 1, characterized in that cooperative means are provided on said housings for locking the housings in an engaged position.

4. The low-insertion-force electrical connector of claim 1, characterized in that said first housing comprises a first portion and a second portion, said first portion having plural windows along opposing sides thereof for receiving a secondary locking mechanism insertable therethrough into engagement with said male pin members.

5. The low-insertion-force electrical connector of claim 4, characterized in that each said male pin member includes a mating shank portion and a pair of spaced apart ribs along said shank portion, and that said secondary locking mechanism engages said male pin member between said ribs.

6. The low-insertion-force electrical connector of claim 4, characterized in that said second portion includes a slot through which said leverage means projects, whereby the movement thereof affects lateral movement of said first housing relative to said second housing and the male pin members with said contact elements.

7. The low-insertion-force electrical connector of claim 5, characterized in that said secondary locking mechanism comprises plural pairs of arms, where each said pair of arms projects into one of said windows into contact with said male pin member.

* * * * *